US010167638B2

(12) United States Patent
Salehi

(10) Patent No.: US 10,167,638 B2
(45) Date of Patent: Jan. 1, 2019

(54) MIXED STUCCO BLOCK

(71) Applicant: Mehran Salehi, Isfahan (IR)

(72) Inventor: Mehran Salehi, Isfahan (IR)

(73) Assignee: Mehran Salehi, Isfahan (IR)

( * ) Notice: Subject to any disclaimer, the term of this patent is extended or adjusted under 35 U.S.C. 154(b) by 0 days.

(21) Appl. No.: 15/853,820

(22) Filed: Dec. 24, 2017

(65) Prior Publication Data

US 2018/0119427 A1 May 3, 2018

(51) Int. Cl.

| | |
|---|---|
| ***E04F 13/07*** | (2006.01) |
| ***E04F 13/04*** | (2006.01) |
| ***E04F 13/08*** | (2006.01) |
| ***E04F 13/075*** | (2006.01) |

(52) U.S. Cl.

CPC ..... *E04F 13/075* (2013.01); *E04F 13/045* (2013.01); *E04F 13/047* (2013.01); *E04F 13/0866* (2013.01); *E04F 13/0889* (2013.01); *E04F 2203/065* (2013.01)

(58) Field of Classification Search

CPC ..... G06Q 30/0631; G06Q 30/0643; G06Q 30/0623; G06K 2209/19; G06K 9/6267

See application file for complete search history.

(56) References Cited

U.S. PATENT DOCUMENTS

| | | | | | |
|---|---|---|---|---|---|
| 1,630,579 | A * | 5/1927 | Payne | C04B 40/006 | 264/333 |
| 3,030,258 | A * | 4/1962 | Wagner | C04B 28/02 | 156/328 |
| 4,093,690 | A * | 6/1978 | Murray | B28B 1/00 | 264/162 |
| 6,787,486 | B1 * | 9/2004 | Gregg | B28B 1/50 | 106/668 |
| 2007/0204548 | A1 * | 9/2007 | Gagne | E04B 2/06 | 52/604 |
| 2013/0074432 | A1 * | 3/2013 | Ciuperca | E04B 1/21 | 52/309.4 |
| 2013/0279979 | A1 * | 10/2013 | Pollack | E01C 5/00 | 404/41 |
| 2014/0272439 | A1 * | 9/2014 | Ram | B32B 13/08 | 428/452 |

* cited by examiner

*Primary Examiner* — Jeanette E Chapman

(57) ABSTRACT

The invention is a mixed stucco block of gypsum blocks. Due to using a layer of compacted polystyrene in its center, it is much lighter than regular gypsum blocks. In addition, its heat transfer coefficient is less than solid stucco panels. In addition, due to applying some smithereens in it along with support system and innovative Rabyts, mechanical connection of cement mortar is provided for it. Therefore it is possible to use this block in wet places including in bathroom, WC, and as the side wall of the façade.

1 Claim, 11 Drawing Sheets

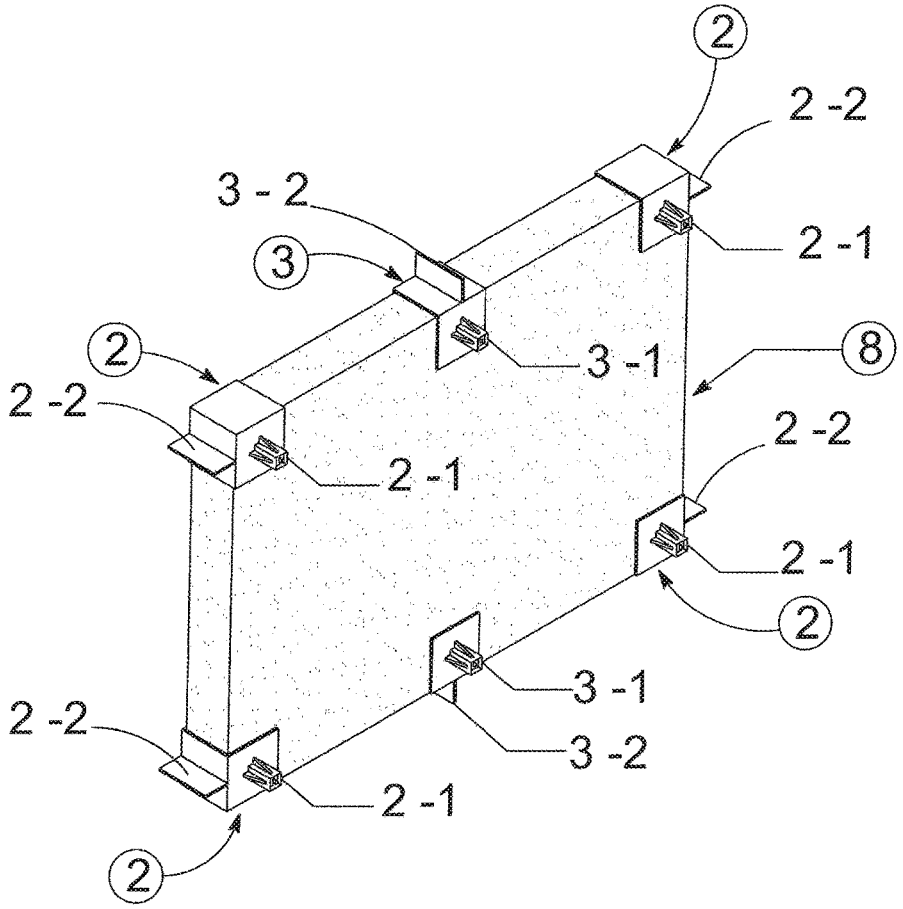
FIG 5 - a

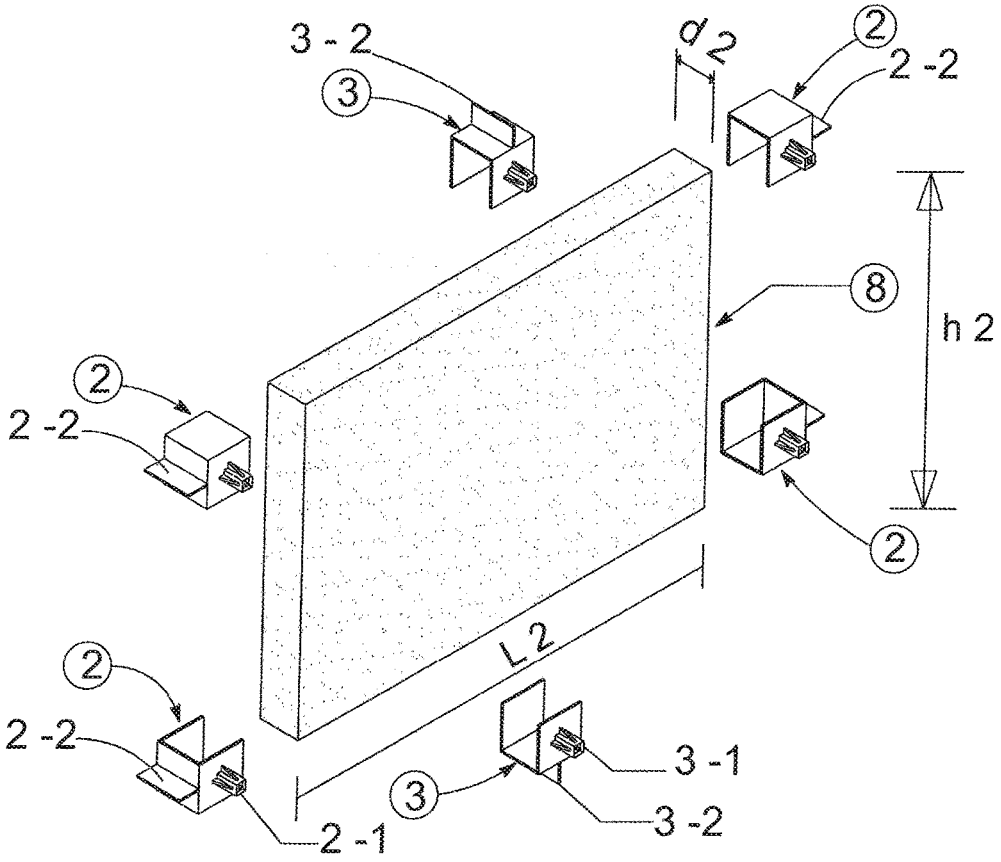
FIG 5 - b

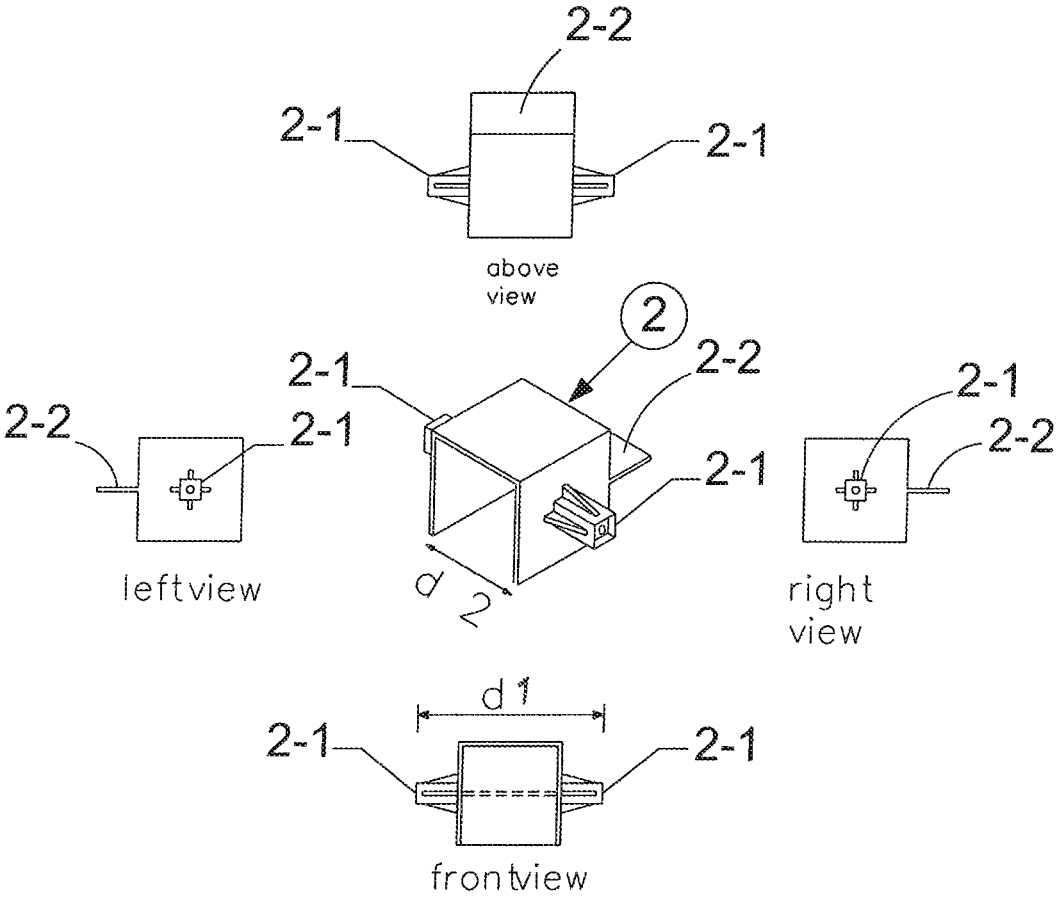
FIG6 -a

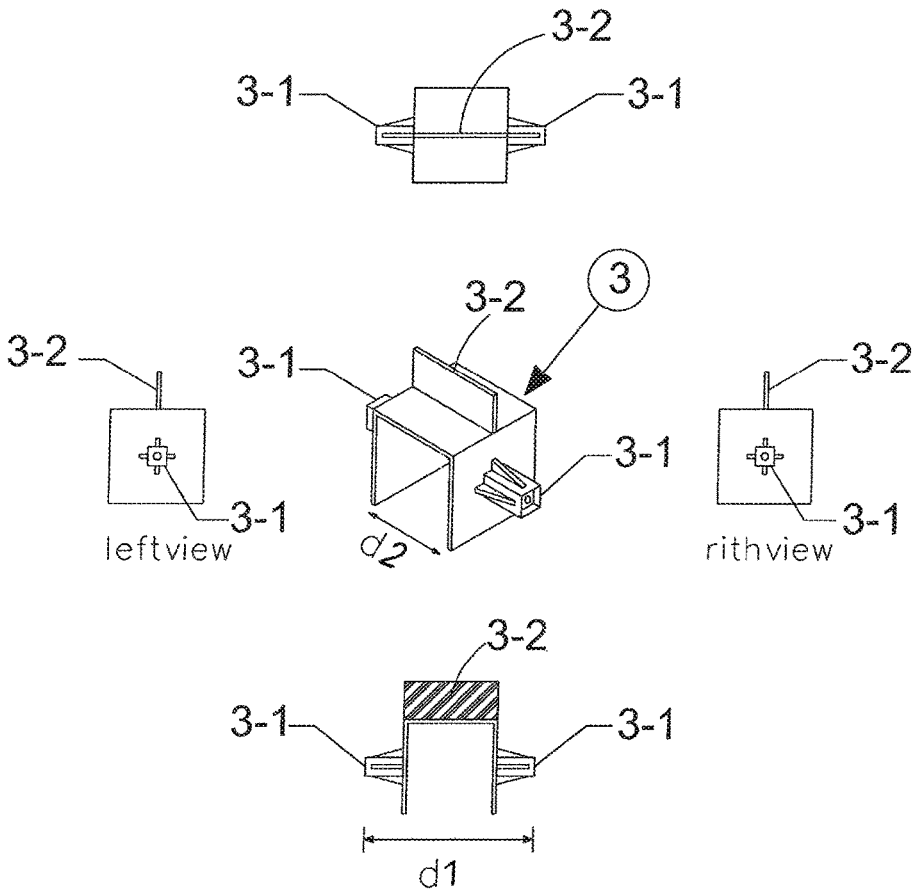
FIG 6 - b

MIXED STUCCO BLOCK

BACKGROUND OF INVENTION

Light weighting, reducing administrative costs, and reducing energy consumption in buildings are very important factors. Applying essential techniques to realize all of them at the same time decreases work costs in time of construct, and decreases energy consumption in operation time. Walls are one of important components of building. Above mentioned items should be applied for them. As there are many walls in buildings, any positive change in them, could be an important step in this regard.

Chalk is one of the cheapest and most abundant materials in the world. History of use of stucco panels for the implementation of retaining walls is about 40 years. Despite the cheapness of these panels, there is not possibility of using them as a side wall or in the bathroom and toilets, because stucco does not stuck to cement. Its parts are relatively high weight. SP composite panels are used as non-load-bearing walls, including internal retaining walls or side walls to light weighting in building, and decreasing costs of work.

SUMMARY OF THE INVENTION

SP is a new form of stucco panels. As white stucco is used in it as its main raw material, it is very cheap. Its surface is flat and it is ready for coloring after putting a thin layer of stucco on it. Unlike ordinary stucco panels, it is possible to use SP as the side wall of the façade, also in wet places such as bath room and WC.

Invention advantages are as follows:

1—Possibility of using panels in wet places, and as the side wall of the façade

2—Its light-weight, reduced in reducing weight of building

3—Reduce the heat transfer coefficient than solid stucco panels, as there is a Yonolit layer in the middle of wall.

4—High-speed of work due to high weight of parts.

5—No need to infrastructure for painting

6—Eliminate the risk of fire due to parts of Yonolit are separated from each other 7—Reduce the required time for drying parts in the manufacturing process.

8—Reduce transportation costs because of the high weighting.

BRIEF DESCRIPTION OF FIGURES

FIG. 5*a*, displays a 3D view of Yonolit 8 sheet with holding parts 2 and 3.

FIG. 5*b*, displays a 3D view of Yonolit 8 sheet with holding parts 2 and 3.

FIG. 6*a*, displays a 3D view and side view of part 2 applied in SP.

FIG. 6*b*, displays a 3D view and side view of part 2 applied in SP.

FULL DESCRIPTION OF THE INVENTION

Figure 1:
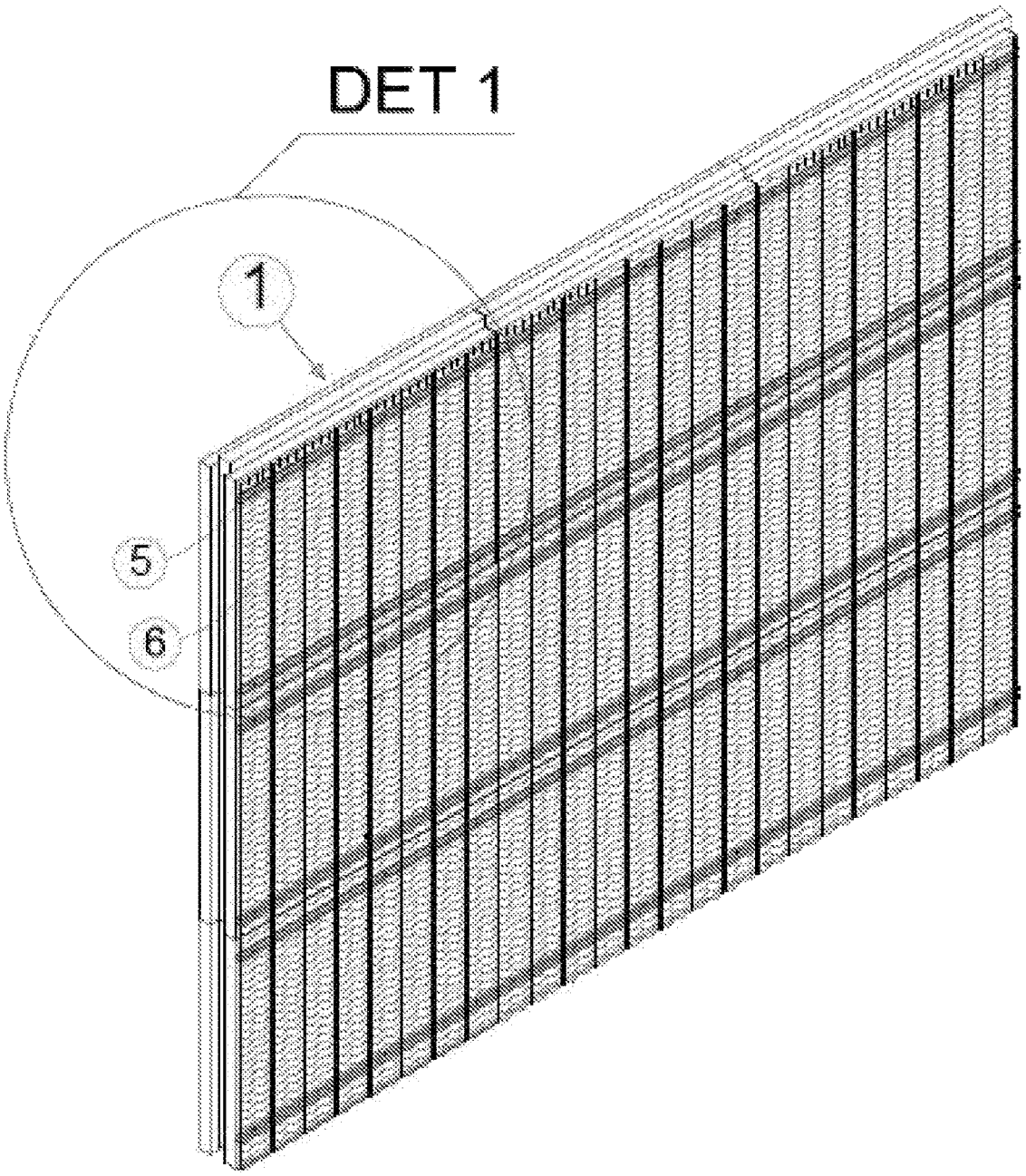
FIG. 1; is a vision of wall systems. It was made by a pattern of the invention pattern. Detail 1 shows a SP.

FIG. 1 shows a wall made of stucco panel (SP). Initially, stucco panel 1 (SP1) (also known as a stucco block) are connected together, such as ordinary stucco panels by a mortar of white stucco and water as dough. Then, metal supports 5 are connected to wall by screw bits 7 by 2-1, 3-1 parts horizontally and parallel with each other. Metal mesh 6 Sheets are connected to support 5 and screw bits 7 in parallel form, as it covers all walls surface. In this phase, the wall is ready for running exterior frontage. Notably, supports 5 and metal grid 6 are in other side of wall, because it is inside the building.

Figure 2:
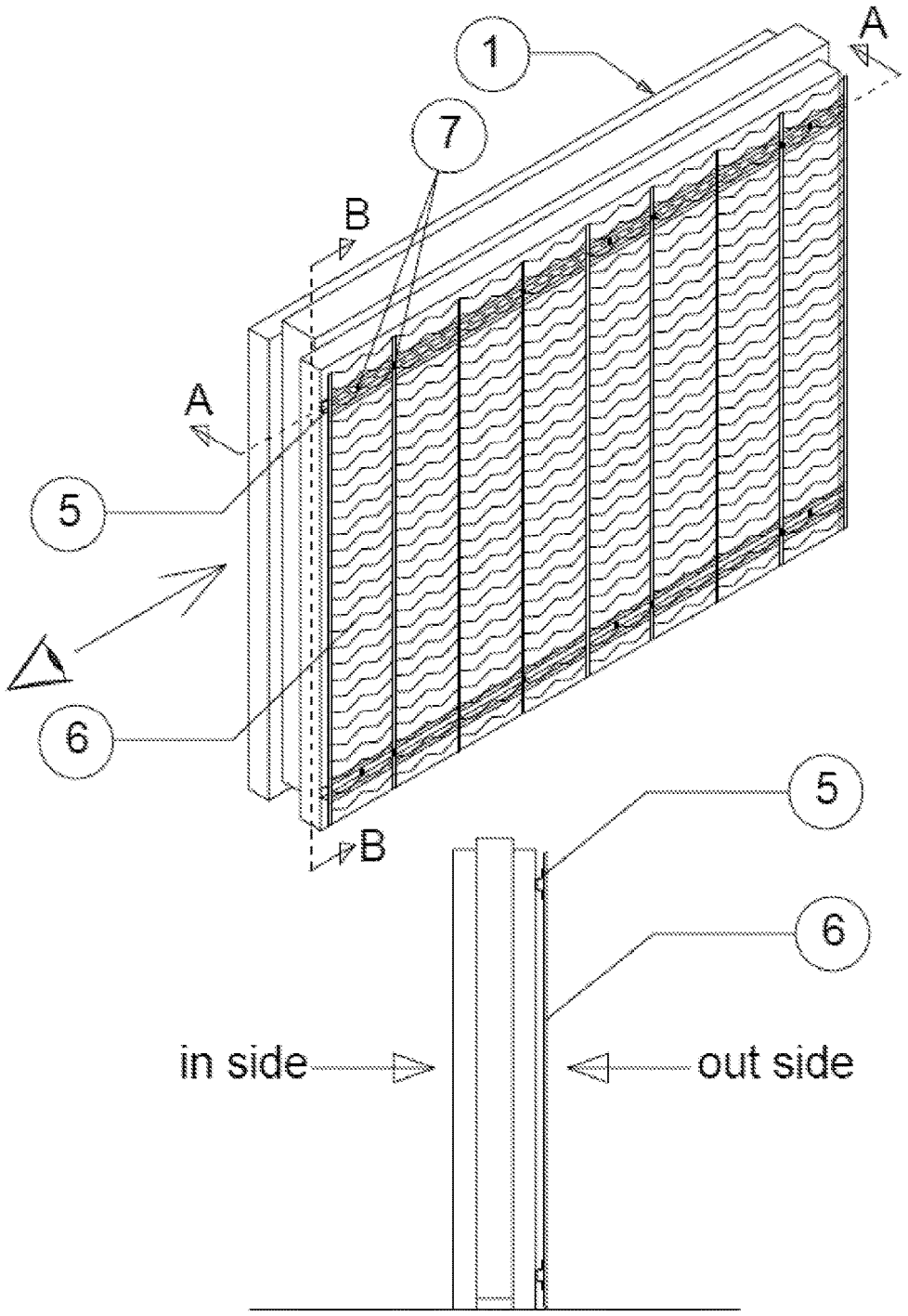
FIG. 2 shows a close vision of a SP, with support system and Rabyts system. A-A and B-B cuts are considered to show details inside the panel.

It is ready for coloring or any other inside cover by run a thin layer of gypsum plaster on the wall. FIG. 2 is a SP, as main body 1 is a combination of white plaster and equal amounts, and metal support 5 and metal net body 6, and Screw bits 7. Each is described completely. Additionally, a side view of the panel is provided. Outside means the exterior f the building, or any part that cement or tile or stone or brick facade were run on it.

Figure 3:
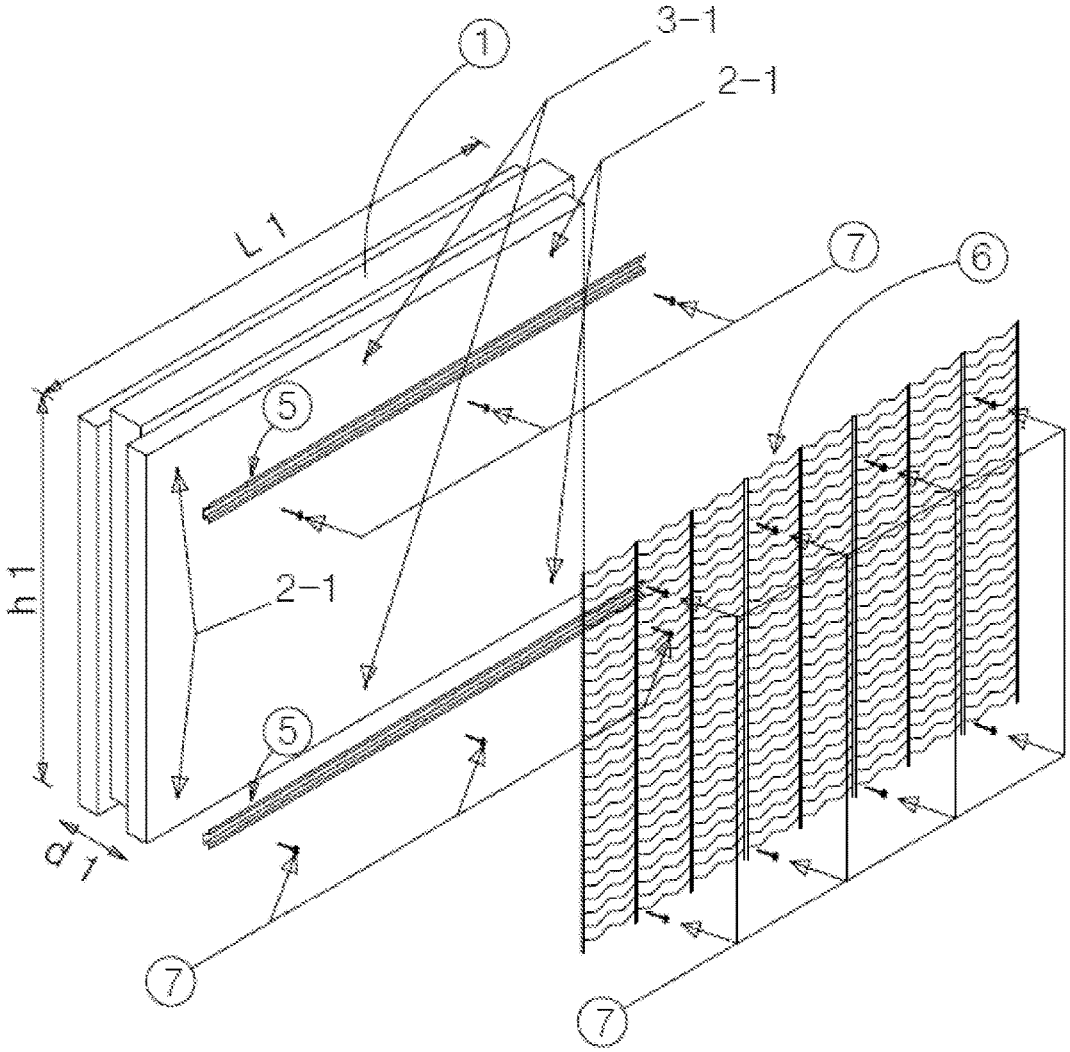
FIG. 3, displays external components of SP.

Support 5 and sheet 6 run by screw 7 to provide mechanical connection on it. Inside part is where a white plaster layer is on it, ready for coloring or any inside view on plaster. Notably, it is possible to implement support system and metal net on both sides of wall, if it is necessary. External components of SP were shown in FIG. 3 separately.

1: It is the main body of SP; that is made of a combination of white plaster and water. Dimensions of this piece are varied but the best one is 666 mm length (L1), 500 mm height ($h_1$), 100 mm depth ($d_1$). It is recommended for better attachment of parts together, such as the figures displayed. There are tongues and grooves in 4 sides of it. A Yonolit 8 (also known as polystyrene) is placed inside this panel. A-A and B-B cuts are considered to be shown. 2-1 and 3-1 components of parts 2 and 3 are visible in the figure. Screws 7 are anchor there, and connect metal supports 5 to the outer body of wall.

5: is a bent metal sheet (support). Its length depends on width of wall. Its thickness should be 1-2 mm. it was connected by screw 7 to components of 2-1 and 3-1 in panel. More details are in map 7.

6: is a metal net sheet. It is connected to support 5 by screw bit 7, as it covers all surface of wall. It provides complete connection between cement mortar and SP. Dimensions and width of these metal nets are different, but it is better to use galvanized Rabyts sheets.

Figure 4:
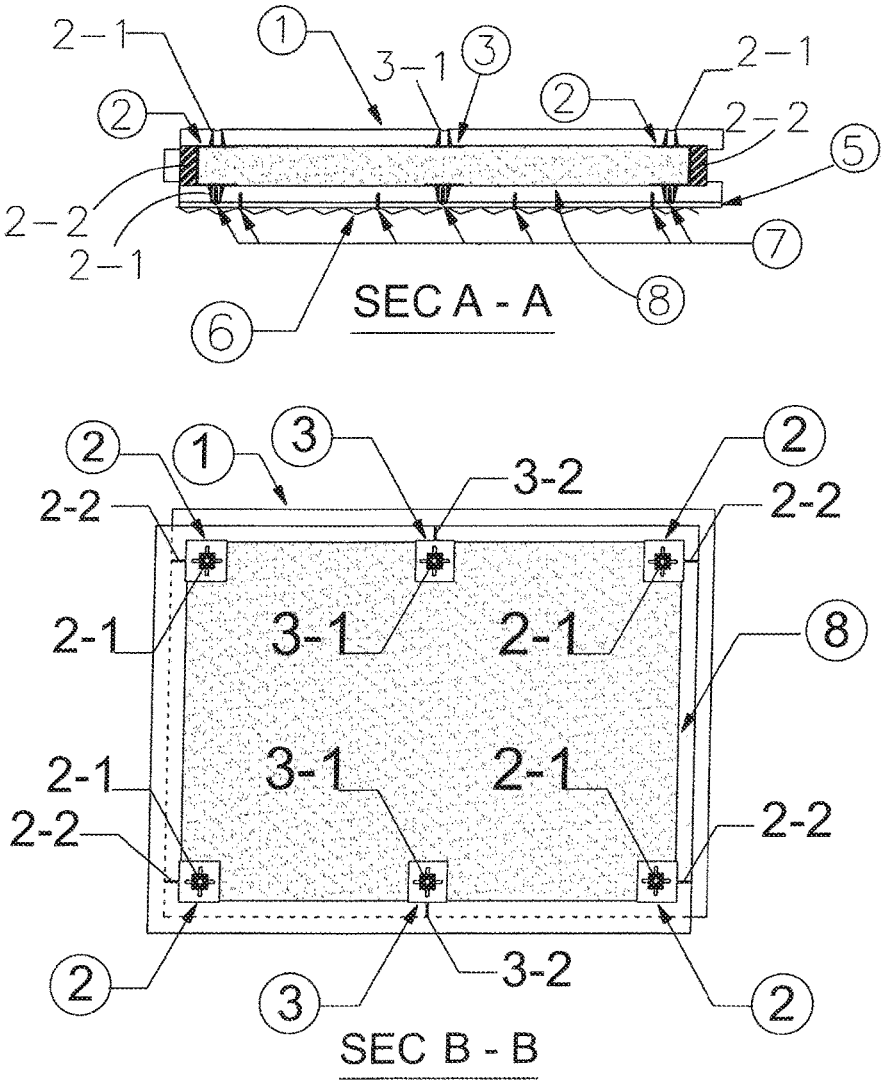
FIG. 4, displays A-A and B-B cuts.

7: is screw bit. They open their way without need to drilling. They increase their speed of work. A-A and B-B cuts are shown in FIG. 4. Yonolit sheet 8 and components 2 and 3 are shown too. 3D vision of Yonolit 8 sheets are shown in this picture, with components 2 and 3 connected to it.

Part 8 is a slow-burning Yonolit sheet to decrease weight of panel, and creating a thermal insulation by parts 2 and 3 in production time is placed in the middle of panel. Dimensions of part 8 depend on dimensions of SP. But, it is suggested to select its dimensions as gypsum slurry covers at least 5 mm around it. 3 dimensional views of parts 2 and 3 and 4 side views of it are shown in FIG. 6. These components are made of resistant plastic. Its dimensions depend on dimensions of panel, and thickness of Yonolit 8, as d1 is the same as thickness of panel, and d2 is the same as thickness of Yonolit 8.

Figure 7:
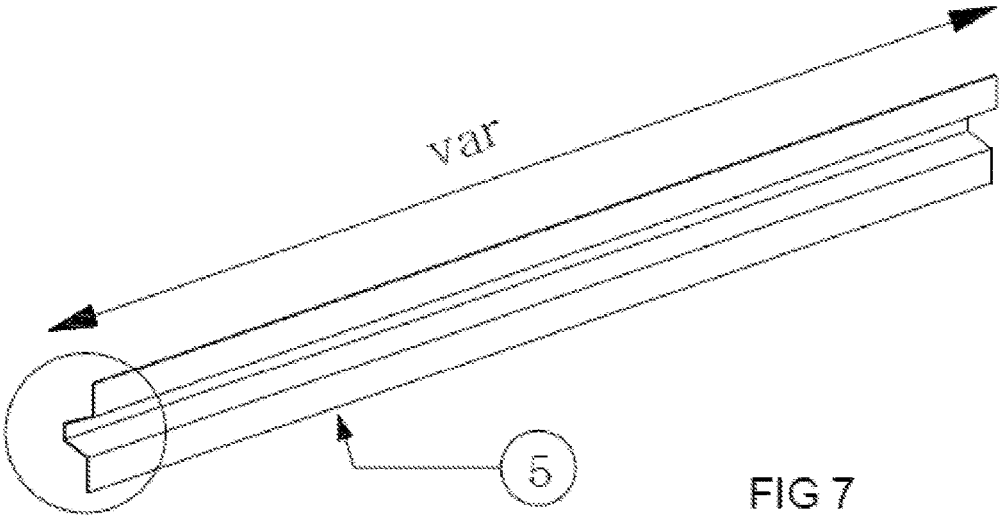
FIG. 7, displays a 3D view and side view of part 3 applied in SP.

Components 2 and 3 have double application. Their first application is in panel production time. It is connected to Yonolit 8, such as FIG. 5. They are put inside the frame with it. By its components 2-1, 2-2, 3-1, and 3-2, it fixes distance between Yonolit 8 and format body. Their second application time is in time of running wall. It works such as dowels. Screws bit 7 are inside 1-2. 3-2 components, and fasten metal 5 supports. According to FIG. 7, part 5 is a bent metal sheet, with desired thickness and width and length. It is suggested to select its thickness as 1-2 mm, its width as 50 to 70 mm, and its length as the same as length of a panel, but its length could be selected as the same as length of wall. Parts 5 are connected to wall by screws bit 7 by 1-2 and 1-3 components. They are used as support to connect metal net sheets 6 together.

Figure 8:
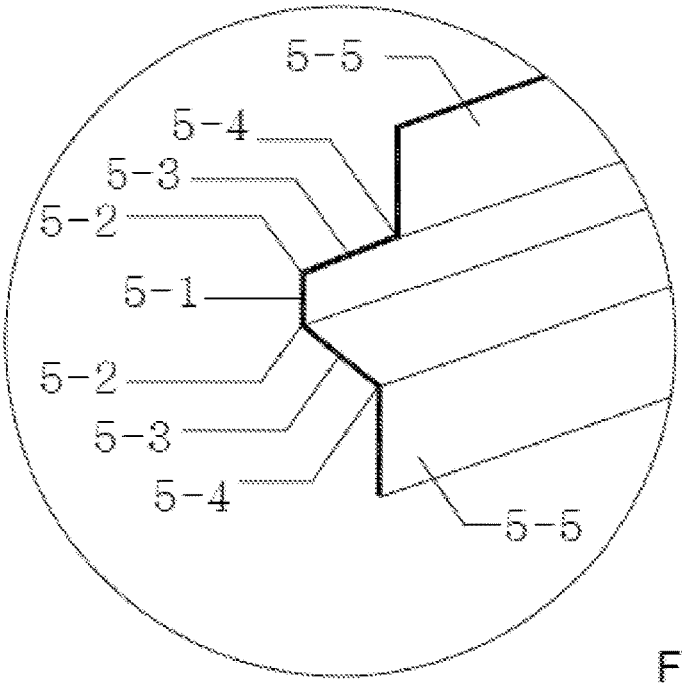
FIG. 8; displays part 5, used as support with its details.
Figure 9:
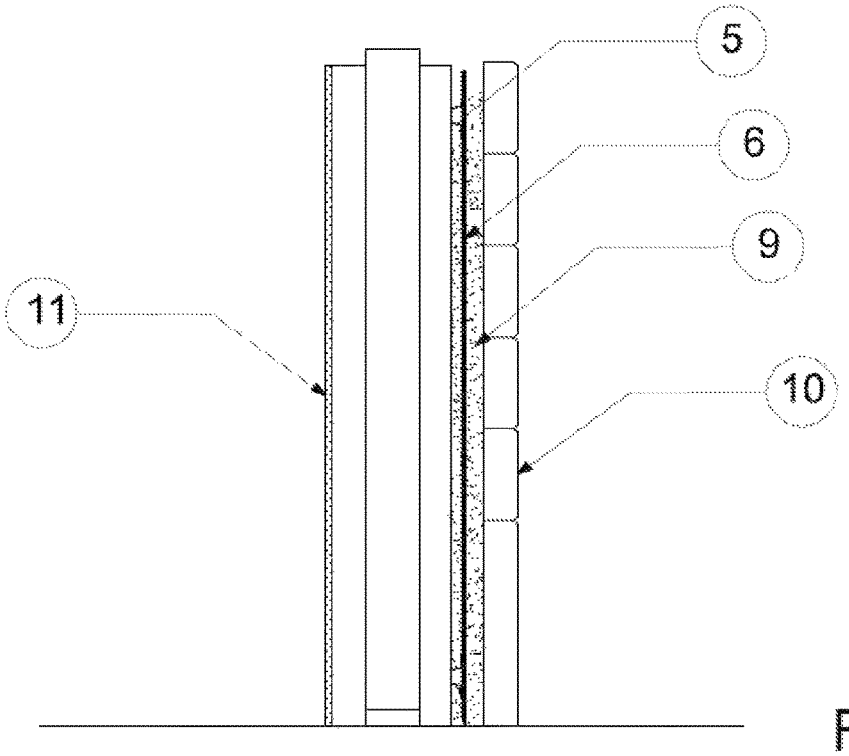
FIG. 9; is a cross section of a built wall by the SP process (after run of exterior facade and interior joinery).

Bending method of part 5 is different, but it is suggested to bend it, such as FIG. 8 to create suitable distance for part 6, by backed edges to provide better engagement for cement mortar.

A proposed section for part 5 is shown in FIG. 8. Actually, 5-1 is seats of part 5, placed on SP. Screw bits 7 are placed on 2-1 and 3-1 components. When connecting metal net sheets 6 to $SP_1$, screws bit 7 connect metal nets 6 to the panel by drilling this section.

5-2 is bending location of sheet 5. Bending angle should be less than 90 degree. 5-3 is diagonal member of part 5. It provides essential distance between sheet 6 and SP. its length should be 10-15 mm. 5-4 is re-bending place of sheet 5. According to bending angle, 5-5 member should be parallel to 5-1 member. 5-5 point plays an important role in mechanical connection of cement mortar to SP. Its length should be 10-15 mm.

FIGS. 5*a* and 5*b* show wall section run by SP, after running external view, and plaster inside the wall. 9 is cement mortar. It is connected to panel by parts 5 and 6. 10 is brick or stone façade. 11 is plaster of white stucco.

Figure 10:
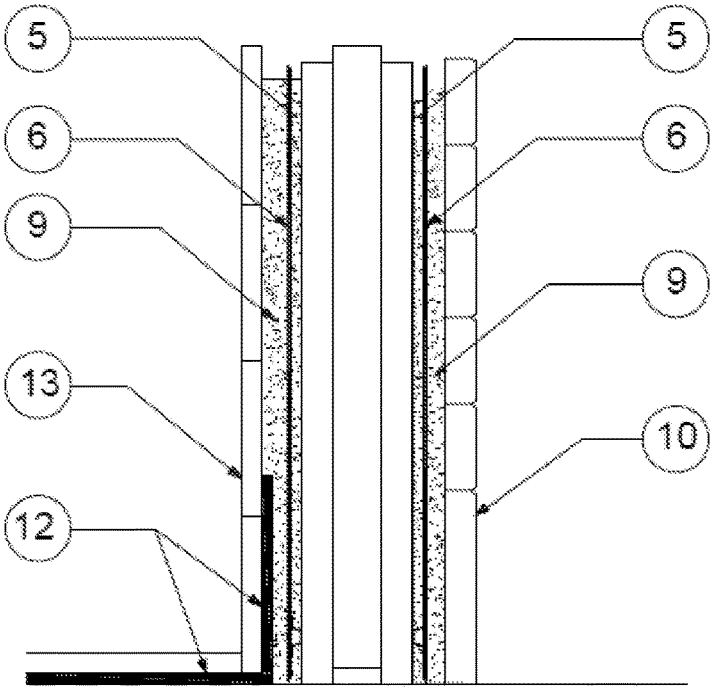
FIG. 10; displays another view of the built wall by the SP (after run of exterior facade and interior joinery).

FIG. 10 shows a section of wall run by SP, after implementing external façade and tiling inside the wall. 12 is insulation. 13 is tile or ceramic.

The invention claimed is:

1. A stucco block, comprising:

a body of stucco plaster comprising a combination of white plaster and water;

a first panel, wherein a first side of the first panel is adjacent to a first side of the body, wherein the first panel does not fully cover the body of stucco plaster, wherein a second side of the first panel faces an inside area of a building, wherein the second side of the first panel is opposite the first side of the first panel;

a second panel, wherein a first side of the second panel is adjacent to a second side of the body, wherein the second panel does not fully cover the body of stucco plaster, wherein a second side of the second panel faces an outside area of the building, wherein the second side of the second panel is opposite the first side of the second panel;

a first female gap corresponding to a first area between the first panel and the second panel on a third side of the stucco block, wherein the first female gap connects the stucco block to a male projection of a second stucco block;

a second female gap corresponding to a second area between the first panel and the second panel on a fourth side of the stucco block, wherein the second female gap connects the stucco block to a male projection of a third stucco block;

a first male projection comprising a first part of the body of stucco plaster on a fifth side of the stucco block, wherein the fifth side of the stucco block is opposite the third side of the stucco block, wherein the first male projection connects the stucco block to a female gap of a fourth stucco block;

a second male projection comprising a second part of the body of stucco plaster on a sixth side of the stucco block, wherein the sixth side of the stucco block is opposite the fourth side of the stucco block, wherein the second male projection connects the stucco block to a female gap of a fifth stucco block;

a plurality of metal supports, wherein each metal support of the plurality of metal supports have at least one of a V shape or a U shape, wherein the plurality of metal supports are parallel to each other, wherein the plurality of metal supports are coupled to the second side of the first panel;

a metal net sheet, coupled to the plurality of metal supports;

a plurality of screw bits, wherein the plurality of screw bits fasten the plurality of metal supports to the first panel, wherein the plurality of screw bits fasten the metal net sheet to the plurality of metal supports;

a plurality of fixtures, coupled to the body of stucco plaster, wherein each fixture of the plurality of fixtures comprises a hole, wherein the plurality of screw bits fasten the metal supports to the first panel using the plurality of fixtures, wherein the plurality of screw bits fasten the metal net sheet to the plurality of metal supports using the plurality of fixtures; and cement mortar between the metal net sheet and the first panel.

* * * * *